United States Patent [19]

Potts

[11] 4,122,971

[45] Oct. 31, 1978

[54] EASY OPENING CAN END WITH PUSH-IN TABS

[75] Inventor: Vinson S. Potts, Cherry Hill, N.J.

[73] Assignee: Crown Cork & Seal Company, Inc., Philadelphia, Pa.

[21] Appl. No.: 863,892

[22] Filed: Dec. 23, 1977

Related U.S. Application Data

[63] Continuation of Ser. No. 701,623, Jul. 1, 1976, which is a continuation-in-part of Ser. No. 637,867, Dec. 4, 1975, abandoned, and Ser. No. 596,530, Jul. 16, 1975, abandoned.

[51] Int. Cl.[2] ..... B65D 41/32

[52] U.S. Cl. ..... 220/268; 220/337; 220/339; 220/359

[58] Field of Search ..... 220/266–270, 220/337, 339, 359

[56] References Cited

U.S. PATENT DOCUMENTS

| | | | |
|---|---|---|---|
| 3,731,835 | 5/1973 | Hawkins et al. | 220/359 X |
| 3,871,550 | 3/1975 | Chiappe | 220/339 |
| 3,889,842 | 6/1975 | Bennett | 220/268 |
| 3,982,658 | 9/1976 | Bozek et al. | 220/337 |

*Primary Examiner*—George T. Hall

*Attorney, Agent, or Firm*—Woodcock, Washburn, Kurtz & Mackiewicz

[57] ABSTRACT

A can end of the easy opening type comprises an end panel having a preformed dispensing opening and a push tab member having an integrally formed rivet for attachment to the end panel. In one embodiment, the end panel includes a peninsular hinge portion having a rivet receiving opening therein such that all deformation during opening is substantially limited to the hinge portion rather than the push-tab member. In another embodiment, an actuator opening is located between the dispensing opening and the rivet receiving opening of the end panel so as to permit a finger engageable protuberance on the push-tab member to extend therethrough.

19 Claims, 8 Drawing Figures

Fig. 6
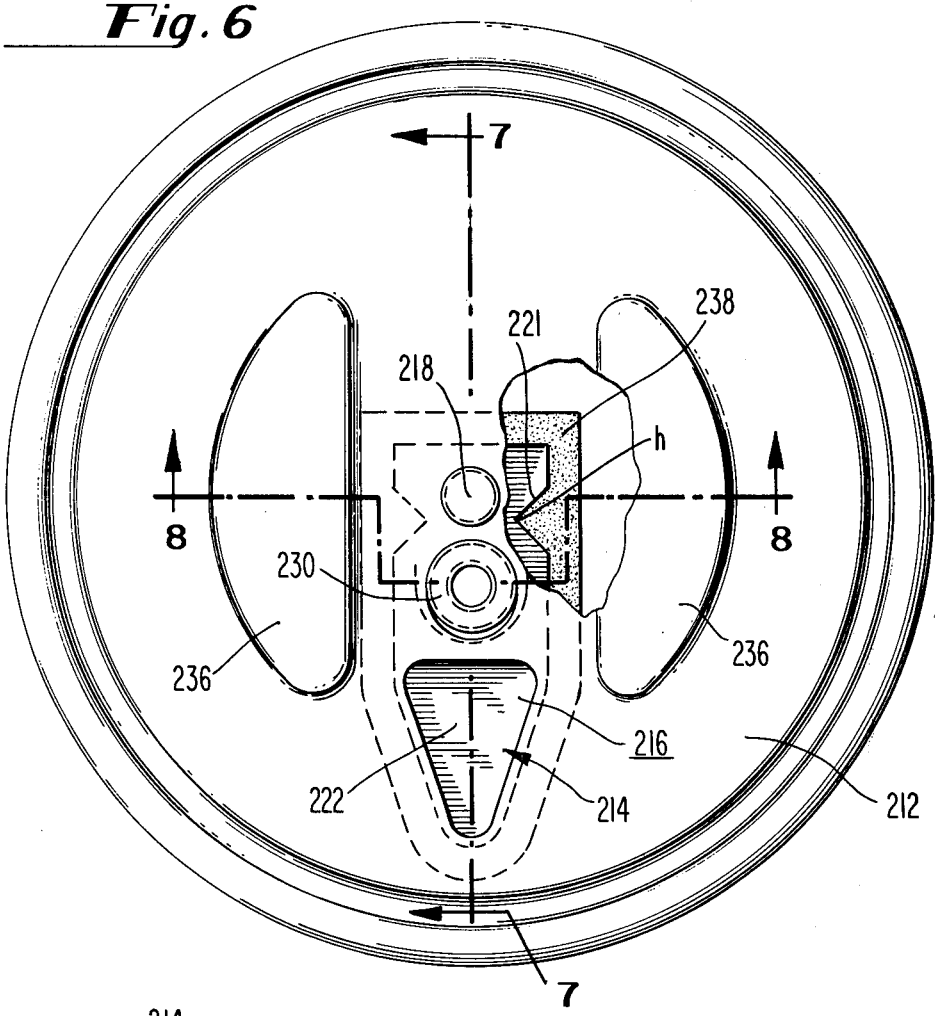
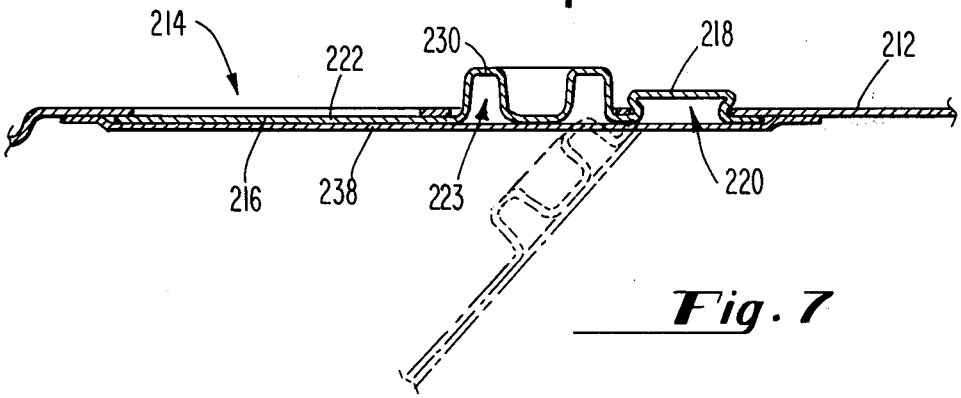
Fig. 7
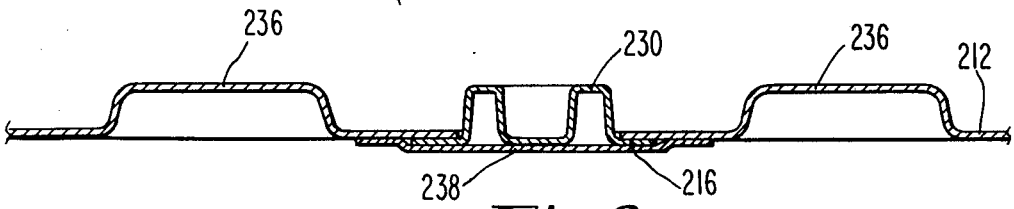
Fig. 8

EASY OPENING CAN END WITH PUSH-IN TABS

RELATED APPLICATIONS

This is a continuation of application Ser. No. 701,623, filed July 1, 1976, which is a continuation-in-part of applications Ser. No. 637,867, filed Dec. 4, 1975 (now abandoned) and Ser. No. 596,530, filed July 16, 1975 (now abandoned).

BACKGROUND OF THE INVENTION

This invention relates to easy opening containers or cans which may be opened by hand without benefit of an opening tool.

To date, the most commercially successful easy opening cans utilize a tab which is formed by scoring the can end panel and removed by grasping a ring attached thereto and ripping out the tab from the end panel along the score lines. Aluminum is usually utilized for a ring-tab ends of this type because its soft and malleable qualities which allow the use of substantial residual scoring depths while still permitting removal of the tab by hand.

However, aluminum can ends are objectionable from a number of standpoints. Aluminum is expensive and of relatively low strength as compared with a metal such as steel so that large quantities of aluminum must be utilized to provide can ends of sufficient gauge to withstand internal pressures generated within the cans. In addition, aluminum is expensive relative to steel, and aluminum can ends are also undesirable as compared with steel from an ecological standpoint since aluminum is not readily degradable. Furthermore, aluminum can ends are often utilized with steel can bodies and this combination is undesirable since an electrochemical reaction may be set up within the can due to its dual metallic nature, thereby creating the risk that the contents within a container may become contaminated or, at a minimum, the taste of those contents may be affected.

As a result, a good deal of emphasis has been placed of late on easy opening can designs which may utilize any metal including steel.

U.S. Pat. No. 3,871,550 - Chiappe discloses an easy opening can end having a preformed or pre-cut dispensing opening which is sealed closed by a plastic closure member bonded otherwise attached to one side of the dispensing opening. The closure member or tab includes an outwardly extending protuberance for engagement by the fingers during opening.

In an easy opening can end of this type, the design must achieve several important functions. First, the means of attaching the closure member must assure that the closure member remains in place. Second, the hinge associated with the closure member should have a memory so as to permit the closure member to remain in the open position during dispensing. Third, means must be provided to permit the push-in closure member to be open all the way without requiring the opener's fingers to be inserted into the container. And fourth, the closure member must be capable of being pushed in with relative ease.

SUMMARY OF THE INVENTION

It is an overall object of this invention to provide an easy opening can end with an improved push-in tab member.

It is a more specific object of this invention to provide easy opening can ends with an improved push-in tab member which is securely attached to the can end panel.

In accordance with these and other objects of the invention, a preferred embodiment of the invention comprises a can end of the easy opening type comprising an end panel having a preformed dispensing opening and a rivet receiving opening. The tab which is adapted to be pushed inwardly includes a rivet which is received by the rivet receiving opening and a closure portion closes the dispensing opening on the interior side thereof.

It is another specific object of this invention to provide a tab having a memory which permits the tab to remain in the open position after opening.

It is a further specific object of this invention to provide a tab which may be opened with relative ease.

In accordance with these specific objects of this invention, the end panel includes a peninsular hinge portion extending into the dispensing opening with the rivet opening being located in the peninsular portion. The peninsular portion is adapted to form a hinge when the tab is pushed inwardly during opening without any substantial deformation of the tab. In a preferred embodiment of the invention, the peninsular portion includes an indentation to provide additional strength. This preferred embodiment also comprises a plastic tab which is located within a recess of the end panel which protrudes outwardly. A tape-like sealing means then extends across the tab within the recess to the end panel at the periphery of the recess.

In accordance with another specific object of the invention, tab may be opened without requiring the fingers to be inserted into the container.

In accordance with this object of the invention, the tab comprises an actuating portion more centrally located on the end panel than the center of the closure portion and the hinge portion is more centrally located than the actuating portion. In one embodiment, an actuating opening separate and distinct from the dispensing opening is provided.

BRIEF DESCRIPTION OF THE DRAWINGS

FIG. 6 is a plan view of a further embodiment of the invention;

FIG. 7 is a fragmentary sectional view of the embodiment of FIG. 6 taken along line 7—7; and FIG. 8 is a fragmentary sectional view of the embodiment of FIG. 6 taken along line 8—8.

DETAILED DESCRIPTION OF THE PREFERRED EMBODIMENTS

Figure 1:
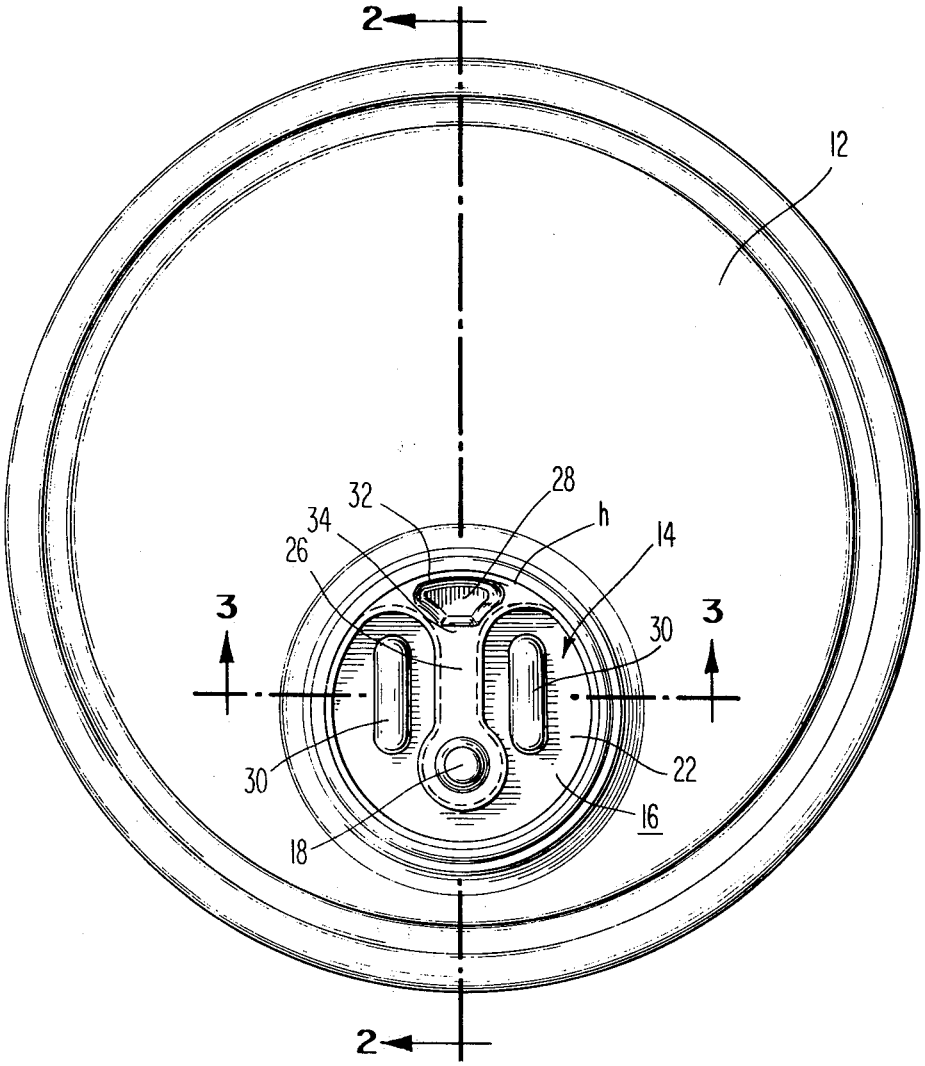
FIG. 1 is a plan view of a preferred embodiment of the invention.
Figure 3:
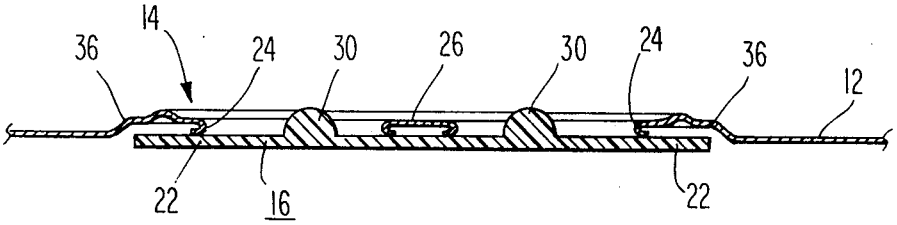
FIG. 3 is a fragmentary sectional view of the embodiment of FIG. 1 taken along line 3—3.
Figure 2:
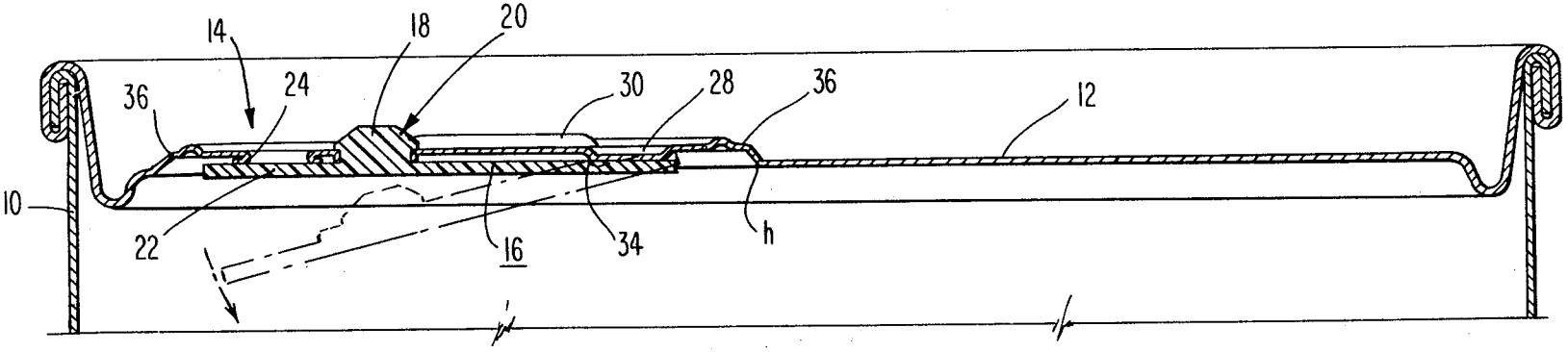
FIG. 2 is a full sectional view of the embodiment of FIG. 1 taken along line 2—2.

As shown in FIGS. 1-3 a can of the easy opening type comprises a can body 10 and an end panel 12 double seamed to the top of the can body 10 in a conventional manner. The panel 12 includes a preformed dispensing opening 14.

In accordance with this invention, the dispensing opening 14 is sealed closed by a push tab member 16 which is secured to the interior side of the end panel 14. The tab comprises an integrally formed rivet 18 which extends outwardly through a rivet receiving opening 20 of the end panel 12. The tab further comprises a closure portion 22 which extends outwardly beyond the periphery of the dispensing opening which is formed by a downwardly and radially outwardly extending curl 24 which prevents the cutting of the fingers during opening. An adhesive not shown is located between the edges of the tab 16 and the curl 24 so as to form a seal between the contents within the interior of the can and the dispensing opening 14.

In accordance with one important aspect of the invention, the end panel includes a peninsular hinge portion 26 which extends into the dispensing opening 14. The peninsular portion 26 which includes the rivet receiving opening 20 is adapted to be deformed inwardly when the push tab member 16 is pushed inwardly during opening as shown in broken lines in FIG. 2. The hinged portion 26 is further adapted to bend along a predetermined hinged line h extending along an indented area 28 which provides additional strength so as to prevent any substantial deformation of the push tab member 16 in the peninsular portion 26.

In accordance with another important aspect of the invention, the push tab member 16 comprises an actuating portion 30 in addition to a closure postion 22 which covers the dispensing opening 14 and the hinge portion 34 located adjacent the indented area 28. The actuating portion 30 protrudes outwardly through the dispensing opening 14 so as to permit finger engagement and opening to the position shown in dotted lines in FIG. 2 without substantial extension of the fingers into the dispensing opening 14. Furthermore, the actuating portion 30 is more centrally located on the end panel than the center of the closure portion 22 and the hinge portion at line *h* is more centrally located than the actuating portion 30 so as to provide a mechanical advantage which assists in establishing a full open position of the push tab member as shown in FIG. 2 without extending the fingers substantially into the interior of the can.

Push tab member 16 as shown in the embodiments of FIG. 1 comprises a plastic of substantial thickness. The thickness of the plastic tab 16 is accommodated by forming the end panel with an outward protrusion or recess 36 in the area of the dispensing opening 14 which receives the plastic push tab 16. Suitable plastic materials include polypropylene, polyethylene, polyesters, nylons or other similar materials.

Figure 5:
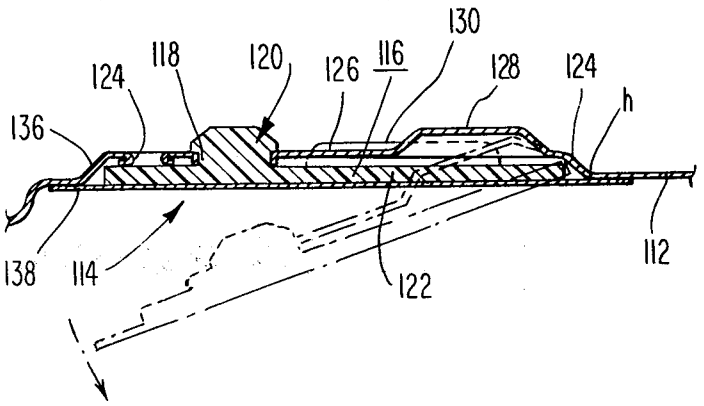
FIG. 5 is a sectional view of the embodiment of FIG. 4 taken along line 5—5.
Figure 4:
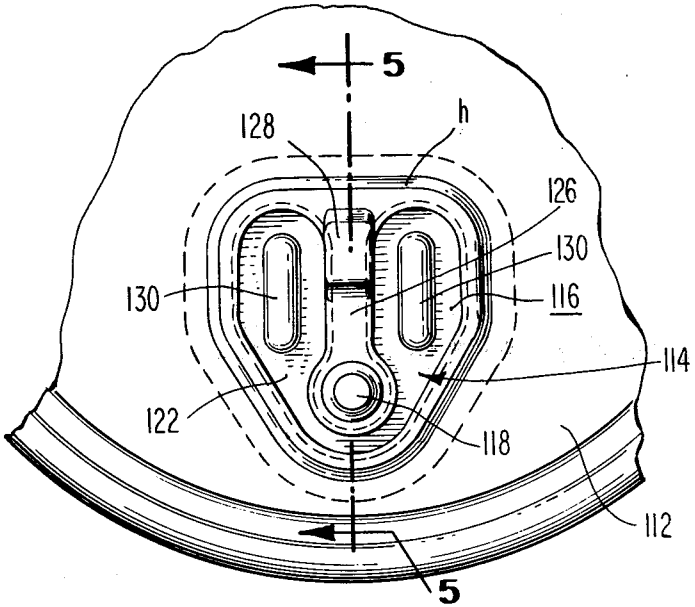
FIG. 4 is a fragmentary plan view of another embodiment of the invention.

The embodiment of FIGS. 4 and 5 is substantially identical to the embodiment of FIGS. 1–3 except for the shape of the push-in tab member and the means by which the seal is achieved between the tab member and the end panel. For this reason, the same reference characters preceded by the numerals 1 are used to describe elements which perform the same function with the same or substantially the same means.

As shown in FIG. 4, the dispensing opening 114 as well as the tab 116 are somewhat elongated as compared with the substantially circular tab and dispensing opening in the embodiment of FIGS. 1–3. As shown in FIG. 5, the seal between the elongated tab member 116 and the interior side of the end panel 112 is achieved by a tape-like member 138 which extends completely across the recess 136 so as to form a seal outwardly of the dispensing opening as well as the recess 136. A suitable tape-like member includes PSDX 46 or 49 or Y-8023 manufactured by the 3M Company or similar type manufactured by other companies. (CC-74). As also shown in FIG. 5, the indented area 128 extends upwardly above the hinge portion at line *h* of the tab 116 rather than downwardly as shown in the embodiments of FIGS. 1–3.

In the embodiment of FIGS. 6–8, an end panel 212 comprises a dispensing opening 214 which is closed by a push-tab member 216. The tab member 216 is attached to a central portion of the end panel 212 by a rivet 218 which is integrally formed with the tab member 216 and extends through a centrally located rivet receiving opening 220. In this embodiment of the invention, the tab 216 bends along a bend line *h* which is established by indentations 221 in the sides of the tab 216.

The tab 216 comprises a closure portion 222 which covers the dispensing opening 214. In order to achieve a seal between the end panel 212 and the tab 216, a flexible tapelike member 238 is provided which extends across the tab 216 into sealing engagement with the end panel 212.

In accordance with one important aspect of this invention, the panel 212 includes an additional opening 223 which receives an actuator 230 more centrally located than the dispensing opening 214 or the closure portion 222 of the tab 216. The actuator 230 allows the tab 216 to be pushed downwardly into the container a substantial distance at the opening 214 without inserting a finger into the container. It will be noted that the panel 212 includes raised portions 236 on both sides of the tab member 216 so as to prevent accidental actuation of the tab 216 by the placing of an object on top of the end panel 212.

The can ends disclosed in the foregoing embodiments may of course comprise steel since there is no scoring or weakening of the can ends. However, it is not necessary that the end comprise steel and other alternatives including aluminum are suitable. In addition, specific materials have been suggested for use in the closure tabs. However, other materials may be utilized.

Various features of the invention are incorporated in the various embodiments disclosed in the aforesaid application Ser. No. 596,530. Accordingly, all of the embodiments of the invention disclosed in application Ser. No. 596,530 are incorporated herein by reference as if set forth in full.

It will therefore be understood that although specific embodiments of the invention have been shown and described and various modifications suggested, other embodiments and modifications will occur to those of ordinary skill in the art and will of course fall within the true spirit and scope of the invention as set forth in the appended claims.

What is claimed is:

1. A can end of the easy opening type comprising:

an end panel having an exterior side and an interior side, said end panel including a preformed dispensing opening and a peninsular hinge portion integrally formed with said end panel and extending into said dispensing opening;

a tab juxtaposed to said opening and said peninsular hinge portion, said tab including a first portion adapted to be permanently attached to said end panel adjacent said hinge portion and a second portion adapted to be releasably attached to said end panel around the periphery of said opening;

sealing means for attaching said first portion and said second portion to said end panel; and said tab including means of attachment to said hinge portion on said exterior side and said interior side of said end panel so as to assure attachment of said tab to said end panel after opening.

2. The can end of claim 1 wherein said means of attachment maintains said tab in substantial contact with said hinge portion after opening to permit the memory of said hinge portion to hold said tab clear of said dispensing opening.

3. The can end of claim 1 wherein said tab comprises a tape-like member forming said first portion and said second portion of said tab.

4. The can end of claim 1 wherein said tab comprises a plurality of layers and said sealing means attaches said layers together.

5. The can end of claim 4 wherein one of said layers comprises a tape-like member.

6. The can end of claim 5 wherein said tape-like member comprises said first portion and said second portion of said tab.

7. The can end of claim 6 wherein said layers are adapted to remain attached after opening.

8. A can end of the easy opening type comprising:

an end panel having an exterior side and an interior side, said end panel including a preformed dispensing opening and a peninsular hinge portion integrally formed with said end panel extending into said dispensing opening; and a tab juxtaposed to said opening and said hinge portion, said tab including a first portion permanently attached to said hinge portion on the interior side and the exterior side of said end panel and a second portion releasably attached to said end panel around said dispensing opening.

9. The can end of claim 8 wherein said tab includes a tape-like member.

10. The can end of claim 9 wherein said tape-like member forms a seal with said end panel.

11. The can end of claim 10 wherein said seal is formed around the periphery of said dispensing opening.

12. The can end of claim 8 wherein said tab comprises a plurality of layers.

13. The can end of claim 12 wherein one of said layers comprises a tape-like member.

14. The can end of claim 13 wherein said tape-like member comprises said first portion and said second portion of said tab.

15. The can end of claim 14 wherein said layers are adapted to remain attached after opening.

16. A can end of the easy opening type comprising:

an end panel including a preformed dispensing opening and a peninsular hinge portion integrally formed with said end panel extending into said opening; and a tab for closing said opening, said tab sandwiching at least a portion of said hinge portion therebetween.

17. The can end of claim 16 wherein said tab comprises a tape-like member.

18. The can end of claim 16 wherein said tab comprises a plurality of layers and sealing means attaches said layers together.

19. The can end of claim 17 wherein one of said layers comprises a tape-like member.

* * * * *